US010687599B2

(12) United States Patent
Kim

(10) Patent No.: US 10,687,599 B2
(45) Date of Patent: Jun. 23, 2020

(54) COSMETIC CONTAINER HAVING COSMETIC MATERIAL STORAGE GROOVE IN IMPREGNATION MEMBER

(71) Applicant: AMOREPACIFIC CORPORATION, Seoul (KR)

(72) Inventor: Jun Young Kim, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 0 days.

(21) Appl. No.: 15/568,904

(22) PCT Filed: May 3, 2016

(86) PCT No.: PCT/KR2016/004659
§ 371 (c)(1),
(2) Date: Oct. 24, 2017

(87) PCT Pub. No.: WO2016/178503
PCT Pub. Date: Oct. 11, 2016

(65) Prior Publication Data

US 2018/0098613 A1 Apr. 12, 2018

(30) Foreign Application Priority Data

May 7, 2015 (KR) ..... 10-2015-0063783

(51) Int. Cl.
*A45D 34/00* (2006.01)
*B65D 77/04* (2006.01)
(Continued)

(52) U.S. Cl.
CPC ..... *A45D 34/00* (2013.01); *A45D 33/02* (2013.01); *A45D 33/025* (2013.01); *A45D 40/22* (2013.01);
(Continued)

(58) Field of Classification Search
CPC ..... A45D 34/00; A45D 40/22; A45D 33/006; A45D 34/06; A45D 33/025; A45D 33/02;
(Continued)

(56) References Cited

U.S. PATENT DOCUMENTS

2005/0087475 A1* 4/2005 Byun ..... A45D 33/025 206/581
2008/0011320 A1* 1/2008 Bouix ..... A45D 33/006 132/293
(Continued)

FOREIGN PATENT DOCUMENTS

KR 10-1410746 B1 1/2014
KR 10-1379692 B1 4/2014
(Continued)

*Primary Examiner* — Robert Poon
(74) *Attorney, Agent, or Firm* — Heedong Chae; Lucem, PC

(57) ABSTRACT

A cosmetic container having a cosmetic material storage groove formed in an impregnation member includes a container body (10), a container cover (20) coupled to one side of the container body (10), and an integrated container (30) provided in the container body (10), wherein the integrated container (30) includes an impregnation member receiving container (40) received in the container body (10) and including the flexible material, the impregnation member (50) received in the impregnation member receiving container (40) and impregnated with a cosmetic material, and a discharge plate (60) bonded to an upper end of the impregnation member receiving container (40) and formed therein with a discharge hole (62). The impregnation member (50) is formed with a cosmetic material storage groove (51) wherein a cosmetic material is stored, and the cosmetic material storage groove (51) is formed with a predetermined depth from a bottom surface of the impregnation member (50).

4 Claims, 7 Drawing Sheets

(51) Int. Cl.

| | |
|---|---|
| ***B65D 47/06*** | (2006.01) |
| ***A45D 33/02*** | (2006.01) |
| ***A45D 40/22*** | (2006.01) |
| ***B65D 21/02*** | (2006.01) |
| ***B65D 47/08*** | (2006.01) |

(52) U.S. Cl.
CPC ..... *B65D 21/0233* (2013.01); *B65D 47/06* (2013.01); *B65D 47/08* (2013.01); *B65D 77/04* (2013.01); *A45D 2200/1045* (2013.01)

(58) Field of Classification Search
CPC ..... A45D 33/34; A45D 2200/1045; B65D 77/04; B65D 77/0433
USPC ..... 206/581, 823
See application file for complete search history.

(56) References Cited

U.S. PATENT DOCUMENTS

2008/0276956 A1* 11/2008 Cho ..... A45D 33/006 132/294
2009/0188518 A1* 7/2009 Thorpe ..... A45D 33/003 132/307
2009/0300865 A1* 12/2009 Spain ..... A45D 33/02 15/105
2014/0311511 A1* 10/2014 Cox ..... A45D 33/34 132/200
2016/0183660 A1* 6/2016 Kim ..... A45D 40/22 53/431
2016/0353857 A1* 12/2016 Kim ..... A45D 33/008
2018/0078018 A1* 3/2018 Lee ..... B65D 83/00
2018/0116371 A1* 5/2018 Kim ..... A45D 34/00
2018/0228266 A1* 8/2018 Caulier ..... A45D 33/003
2020/0017271 A1* 1/2020 Lee ..... B65D 83/00

FOREIGN PATENT DOCUMENTS

| | | | |
|---|---|---|---|
| KR | 10-1410746 | B1 | 6/2014 |
| KR | 10-1476314 | B1 | 12/2014 |
| KR | 10-1481545 | B1 | 1/2015 |
| KR | 10-2015-0019782 | A | 2/2015 |
| WO | 2015026092 | A1 | 8/2014 |

* cited by examiner

-- Prior Art --

-- Prior Art --

COSMETIC CONTAINER HAVING COSMETIC MATERIAL STORAGE GROOVE IN IMPREGNATION MEMBER

CROSS-REFERENCE TO RELATED APPLICATION

This application claims the benefit of Korean application No. 10-2015-0063783, filed on May 7, 2015 with the Korean Intellectual Property Office, the disclosure of which is incorporated herein by reference.

TECHNICAL FIELD

The present invention relates to a cosmetic container having a cosmetic material storage groove formed in an impregnation member, and more particularly, to a cosmetic container having a cosmetic material storage groove formed in an impregnation member, in which an impregnation member impregnated with a cosmetic material is received in a impregnation member receiving container formed of a flexible material, a discharge plate is provided on the impregnation member receiving container, the impregnation member receiving container is bonded to the discharge plate to form an integrated container, and the integrated container is regarded as one part and assembled when the cosmetic container is assembled, thereby preventing a cosmetic material impregnating process from being included in the assembling process, so that the productivity can be improved, and the failure rate of a product can be reduced, and the impregnation member is formed therein with a plurality of cosmetic material storage grooves, and the cosmetic material is stored even in the cosmetic material storage grooves when the cosmetic material is impregnated, so that the cosmetic material stored in the cosmetic material storage grooves is absorbed into the impregnation member after the cosmetic material impregnated in the impregnation member has been discharged when a user presses the discharge plate, thereby allowing the cosmetic material to be filled in the impregnation member for a long time so the user needs not refill the cosmetic material frequently and can conveniently use the cosmetic material.

BACKGROUND ART

Cosmetics refer to compositions which are used for a human body in order to add charming of the human body by making the human body clean and beautiful, to change the appearance of the human body into being brighter, to maintain skin or hair in a healthy state, or to enhance the skin or the hair, and to exert slight influence on the human body.

In general, the cosmetics are obtained by mixing an emulsifier, such as a surfactant, with a cosmetic material having a different formulation, and classified into water-in-oil type and oil-in-water type cosmetics depending on the bonding structures of water-phase and oil-phase materials.

The water-in-oil type cosmetic material is obtained by bonding an oil-phase material to an outer portion of the water-phase material. The water-in-oil type cosmetic material contains a great amount of oil, and thus slowly absorbed in the skin, which makes a user feel heavy. However, the water-in-oil type cosmetic material has a long-lasting effect higher than that of the oil-in-water type cosmetic material. Cosmetics required with a higher long-lasting effect are prepared using the oil-in-water type cosmetic material so that water resistance to sweat or water may be enhanced.

In order to overcome the disadvantages of sticky and heavy feeling for the water-in-oil type cosmetic material, the cosmetics are prepared with lower viscosity. However, the lower-viscosity water-in-oil type cosmetics are divided into a water-phase material, which is an inner material, and an oil-phase material, which is an outer material, when being stored in a container for a long time during the distribution. Accordingly, a user must inconveniently use the water-in-oil type cosmetics by shaking a cosmetic container so that the water-phase material and the oil-phase material are mixed with each other.

In order to solve the above problem, the present applicant is issued with Korea Patent Registration No. 10-1257628 which discloses low-viscosity water-in-oil type contents impregnated into an impregnation member 1 and contained in a compact container as shown in FIG. 1.

However, the related art discloses a simple structure in which a cosmetic material is impregnated into the impregnation member 1, and the impregnation member 1 is pressed and used with a puff when a user uses the cosmetic material. Accordingly, the cosmetic material may not be uniformly discharged from the impregnation member 1, or may be overflowed from the impregnation member 1.

Further, in order to solve the problem, there is issued Korean Patent Registration No. 10-1476314 which discloses an impregnation member 2 impregnated with a cosmetic material and provided therein with a cosmetic material discharge channel 3 to constitute a passage when the cosmetic material is discharged, thereby preventing the cosmetic material from being excessively discharged through the discharge channel 3 or from being overflowed out of the impregnation member 2 when the cosmetic material is discharged as shown in FIG. 2.

However, according to the related art, since the impregnation member 2 to be impregnated with the cosmetic material is inserted into the cosmetic container and then the cosmetic material is impregnated in the impregnation member 2, a cosmetic material impregnating process is included in a cosmetic container assembling process. Accordingly, the time to fill the cosmetic material is excessively taken so that the productivity may be degraded. In addition, the cosmetic container assembling process and the cosmetic material impregnating process are mixed, so that the failure rate of a product may be increased.

In addition, since an amount of a cosmetic material to be impregnated in the impregnation member 2 is limited, a user may not use a large amount of a cosmetic material, and must frequently refill the cosmetic material. Accordingly, refill container resources may be wasted.

DISCLOSURE

Technical Problem

The present invention is suggested in order to solve the above problems, and an object of the present invention is to provide a cosmetic container having a cosmetic material storage groove formed in an impregnation member, in which an impregnation member impregnated with a cosmetic material is received in a impregnation member receiving container formed of a flexible material, a discharge plate is provided on the impregnation member receiving container, the impregnation member receiving container is bonded to the discharge plate to form an integrated container, and the integrated container is regarded as one part and assembled when the cosmetic container is assembled, thereby preventing a cosmetic material impregnating process from being included in the assembling process, so that the productivity can be improved, and the failure rate of a product can be reduced.

Another object of the present invention is to provide a cosmetic container having a cosmetic material storage groove formed in an impregnation member, in which an impregnation member is formed therein with a plurality of cosmetic material storage grooves, and the cosmetic material is stored even in the cosmetic material storage grooves when the cosmetic material is impregnated, so that the cosmetic material stored in the cosmetic material storage grooves is absorbed into the impregnation member after the cosmetic material impregnated in the impregnation member has been discharged when a user presses the discharge plate, thereby allowing the cosmetic material to be filled in the impregnation member for a long time so the user needs not refill the cosmetic material frequently and thus can conveniently use the cosmetic material.

Technical Solution

According to the present invention, there is provided a cosmetic container having a cosmetic material, storage groove formed in an impregnation member. The cosmetic container includes a container body (10), a container cover (20) coupled to one side of the container body (10), and an integrated container (30) provided in the container body (10). The integrated container (30) includes an impregnation member receiving container (40) received in the container body (10) and including a flexible material, an impregnation member (50) received in the impregnation member receiving container (40) and impregnated with a cosmetic material, and a discharge plate (60) bonded to an upper end of the impregnation member receiving container (40) and formed therein with a discharge hole (62). The impregnation member (50) is formed therein with a cosmetic material storage groove (51) in which a cosmetic material is stored when the cosmetic material is impregnated, and the cosmetic material storage groove (51) is formed with a predetermined depth from a bottom surface of the impregnation member (50) without being formed through the impregnation member (50).

In addition, a fixing member (80) is additionally coupled to an upper portion of the container body (10) to fix the integrated container (30) such that the integrated container (30) is prevented from deviating from the container body (10).

Further, an elastic member (55) is additionally coupled, to an outer portion of the integrated container (30) to increase elasticity of the integrated container (30).

Further, a receiving container bonding part (41) is formed on an edge of the impregnation member receiving container (40), a discharge plate bonding part (61) is formed on an edge of the discharge plate (60), and the receiving container bonding part (41) is mutually bonded to the discharge plate bonding part (61) to form a bonding part (70).

Further, the bonding part (70) is formed through a thermal bonding scheme, an ultrasonic bonding scheme, or a high frequency bonding scheme.

Advantageous Effects

As described above, according to the cosmetic container having the cosmetic material storage groove formed in the impregnation member, the impregnation member impregnated with the cosmetic material is received in the impregnation member receiving container formed of the flexible material, the discharge plate is provided on the impregnation member receiving container, the impregnation member receiving container is bonded to the discharge plate to form the integrated container, and the integrated container is regarded as one part and assembled when the cosmetic container is assembled, thereby preventing the cosmetic material impregnating process from being included in the assembling process, so that the productivity can be improved, and the failure rate of a product can be reduced.

In addition, according to the cosmetic container having the cosmetic material storage groove formed in the impregnation member, the impregnation member is formed therein with the cosmetic material storage grooves, and the cosmetic material is stored even in the cosmetic material storage grooves when the cosmetic material is impregnated, so that the cosmetic material stored in the cosmetic material storage grooves is absorbed into the impregnation member after the cosmetic material impregnated in the impregnation member has been discharged when a user presses the discharge plate, thereby allowing the cosmetic material to be filled in the impregnation member for a long time so the user needs not refill the cosmetic material frequently, and the refill container resource can be prevented from being wasted.

BEST MODE

Mode for Invention

Hereinafter, a cosmetic container having a cosmetic material storage groove formed in an impregnation member according to one embodiment of the present invention will be described in detail with reference to accompanying drawings.

Figure 1:
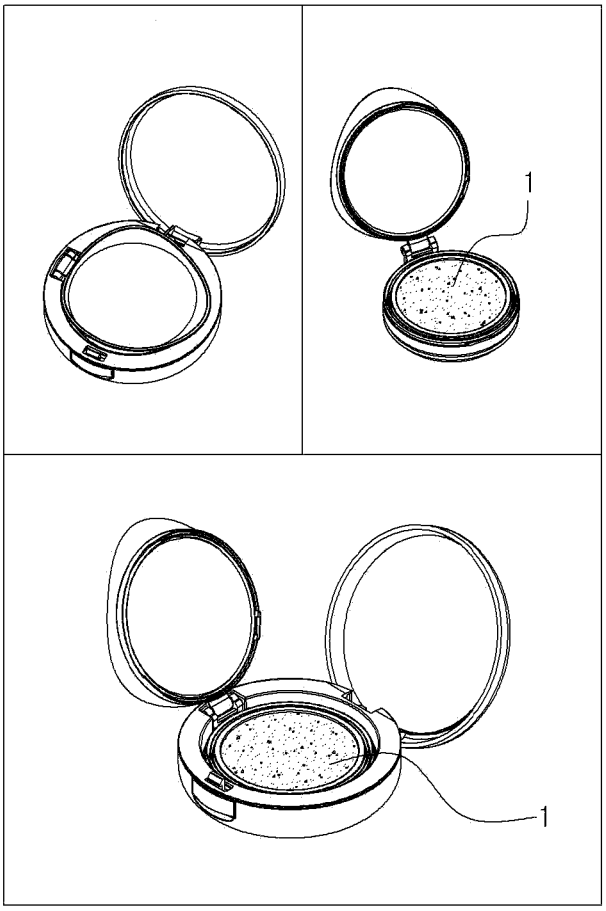
FIG. 1 is a perspective view showing an open compact container according to the related art.
Figure 2:
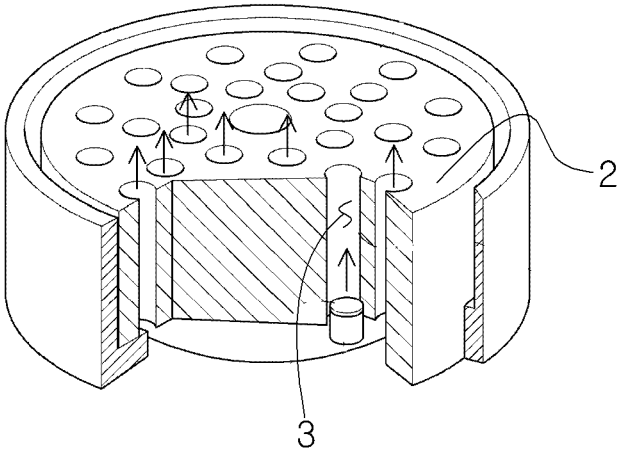
FIG. 2 is a partially cut-out perspective view showing an impregnation member impregnated with a cosmetic material according to the related art.
Figure 3:
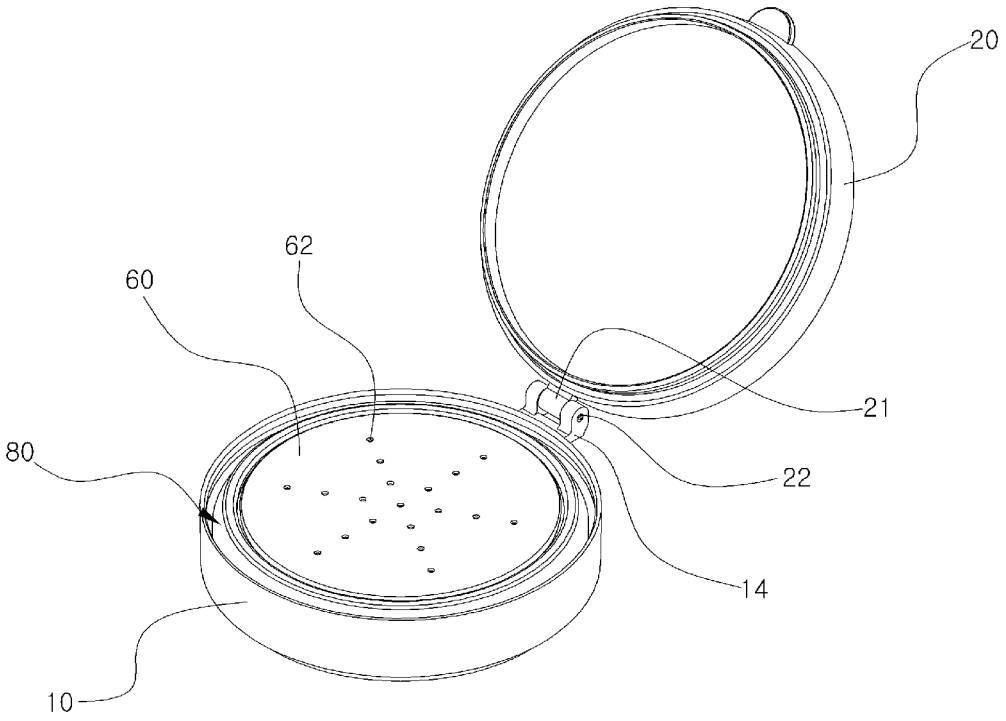
FIG. 3 is a perspective, view showing the cosmetic container having the cosmetic material storage groove formed in the impregnation member according to one embodiment of the present invention.
Figure 4:
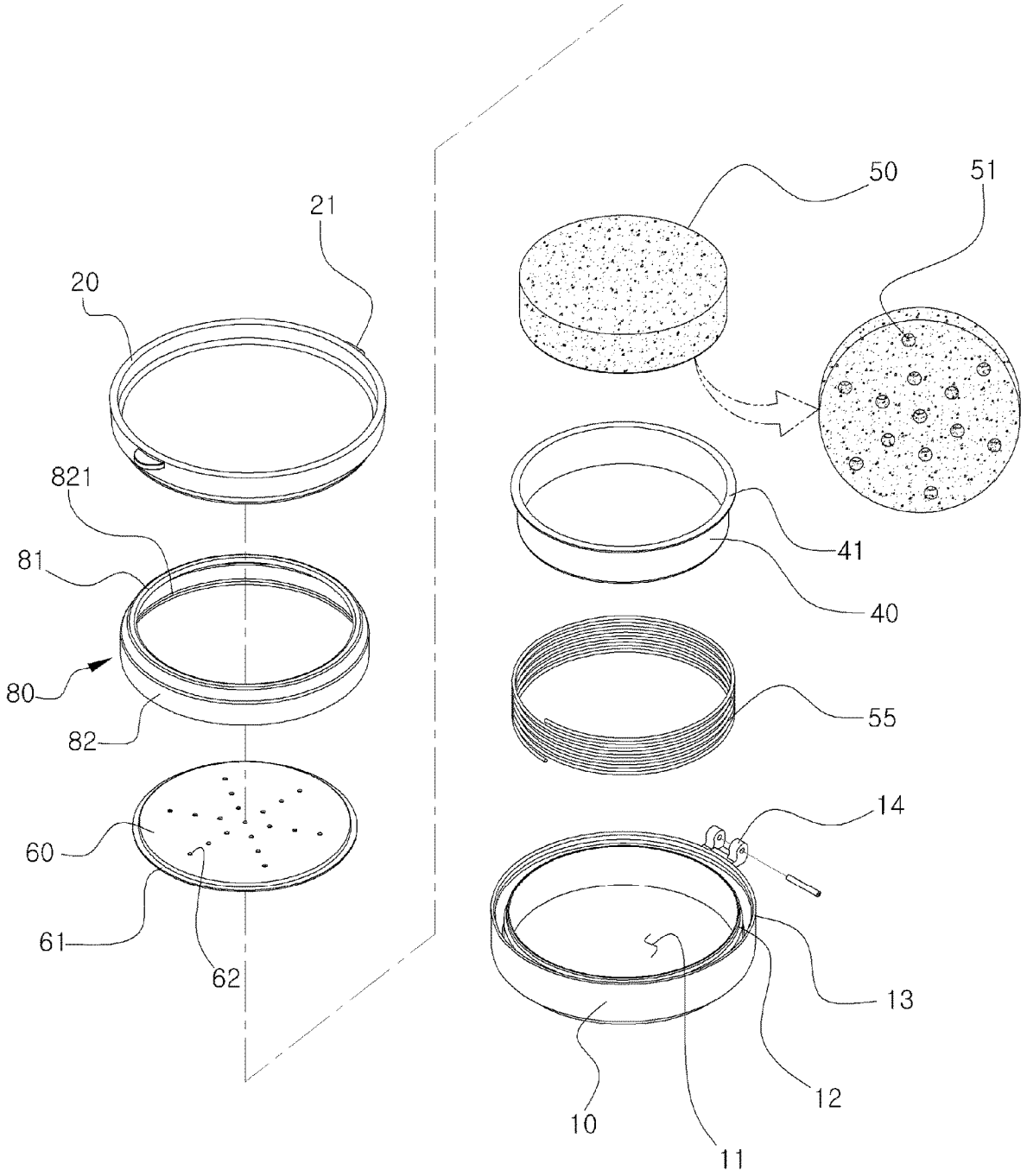
FIG. 4 is an exploded perspective view showing the cosmetic container having the cosmetic material storage groove formed in the impregnation member according to one embodiment of the present invention.
Figure 5:
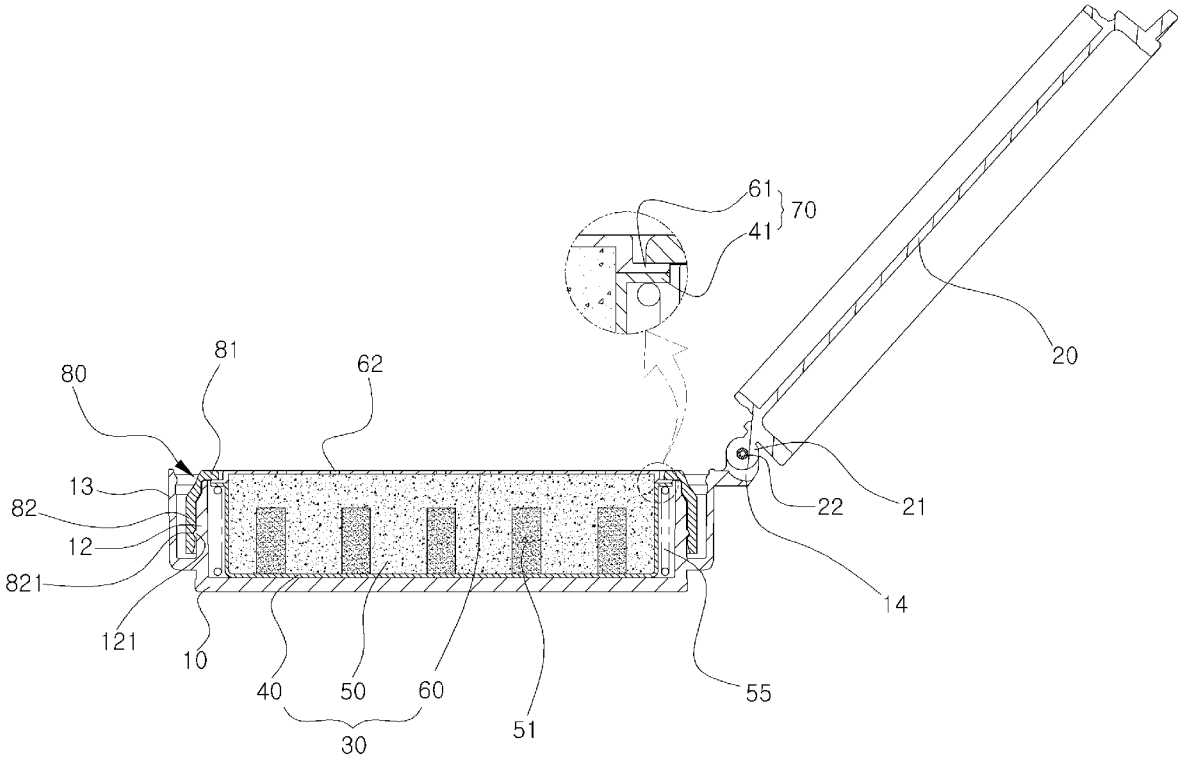
FIG. 5 is a sectional view showing the cosmetic container having the cosmetic material storage groove formed in the impregnation member according to the embodiment of the present invention.
Figure 6:
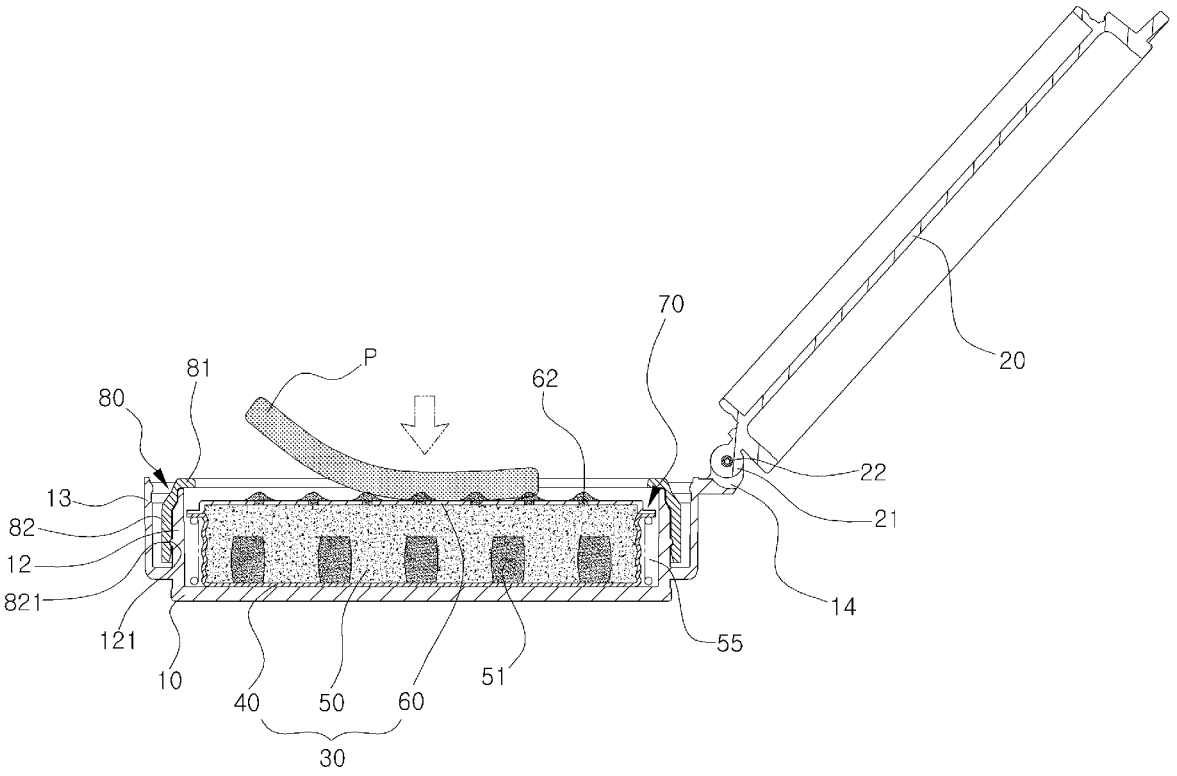
FIG. 6 is a sectional view showing a state of pressing a discharge plate in the cosmetic container having the cosmetic material storage groove formed in the impregnation member according to the embodiment of the present invention.
Figure 7:
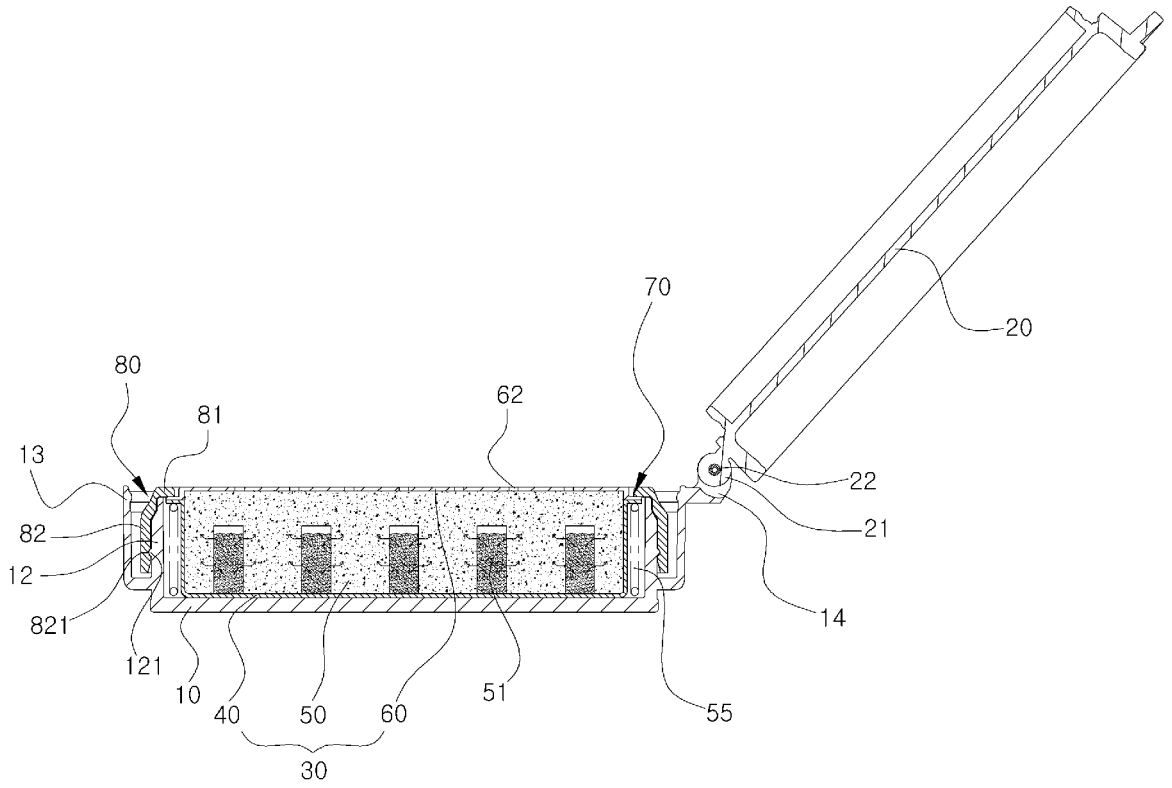
FIG. 7 is a sectional view showing a state of releasing the pressing of the discharge plate in the cosmetic container having the cosmetic material storage groove formed in the impregnation member according to the embodiment of the present invention.

FIG. 3 is a perspective view showing the cosmetic container, having the cosmetic material storage groove formed in the impregnation member according to one embodiment of the present invention, FIG. 4 is an exploded perspective view showing the cosmetic container having the cosmetic material storage groove formed in the impregnation member according to one embodiment of the present invention, and FIG. 5 is a sectional view showing the cosmetic container having the cosmetic material storage groove formed in the impregnation member according to the embodiment of the present invention. FIG. 6 is a sectional view showing a state of pressing a discharge plate in the cosmetic container having the cosmetic material storage groove formed in the impregnation member according to the embodiment of the present invention, and FIG. 7 is a sectional view showing a state of releasing the pressing of the discharge plate in the cosmetic container having the cosmetic material storage groove formed in the impregnation member according to the embodiment of the present invention.

The cosmetic container having the cosmetic material storage groove formed in the impregnation member according to the present invention includes a container body 10, a container cover 20 coupled to one side of the container body 10, and an integrated container 30 provided in the container body 10. The integrated container 30 includes an impregnation member receiving container 40 received in the container body 10 and formed of a flexible material, an impregnation member 50 received in the impregnation member receiving container 40 and impregnated with a cosmetic material, and a discharge plate 60 bonded to an upper end of the impregnation member receiving container 40 and formed therein with a discharge hole 62.

The container body 10 includes a bottom surface 11, an inner wall 12 extending upward from the bottom surface 11, and an outer wall 13 spaced apart from an outer portion of the inner wall 12 by a predetermined distance and extending.

The inner wall 12 is formed on an outer circumferential surface thereof with a coupling protrusion 121, and the coupling protrusion 121 is fitted into a coupling groove 821 formed in a fixing member 80 to prevent the fixing member 80 from being separated from the container body 10.

A hinge bracket 14 is formed on an outer circumference of an upper portion of the outer wall 13.

The container cover 20 is formed at one side thereof with a hinge block 21, and the hinge block 21 is fitted into the hinge bracket 14 of the container body 10, and hinged with the container body 10 by a hinge pin 22.

The integrated container 30 is provided in the container body 10.

The integrated container 30 includes the impregnation member receiving container 40 received in the container body 10 and formed of a flexible material, the impregnation member 50 received in the impregnation member receiving container 40 and impregnated with the cosmetic material, and the discharge plate 60 bonded to an upper end of the impregnation member receiving container 40 and formed therein the discharge hole 62.

The integrated container 30 is regarded as one part and assembled when the cosmetic container is assembled. Accordingly, since the cosmetic material impregnating process is not included in the cosmetic container assembling process, the productivity may be improved and the failure rate of a product may be reduced.

The impregnation member receiving container 40 is formed on an upper edge thereof with a receiving container bonding part 41 and formed of a flexible material so that the impregnation member receiving container 40 may be easily pressed or recovered. The flexible material includes at least one of polyethylene, urethane rubber, nitrile-butadiene rubber (NBR), silicone, and polyvinyl.

As the impregnation member receiving container 40 is formed of a flexible material, the impregnation member receiving container 40 may be easily pressed or released from the pressing state when the discharge plate 60 is pressed or released from the pressing state as shown in FIGS. 6 and 7.

The impregnation member 50 impregnated with the cosmetic material is provided in the impregnation member receiving container 40, and formed therein with a plurality of cosmetic material storage grooves 51 in which a cosmetic material is stored when the cosmetic material is impregnated.

The impregnating member 50 includes at least one selected from the group consisting of Butadiene Rubber (BR), Styrene Butadiene Rubber (BBR), Natural Rubber (NR), Natural Rubber Styrene Butadiene Rubber (MRSBR), Acrylonitrile-butadiene Rubber (NBR), wet polyurethane, dry polyurethane, polyether, polyester, polyvinyl chloride, polyethylene, latex, silicone, Polyvinyl Alcohol (PVA), nitrile rubber, butyl rubber, and neoprene.

The cosmetic material storage grooves 51, which are formed in a lower end of the impregnation member 50, are not formed through the impregnation member 50, but formed with a predetermined depth from a bottom surface to additionally store the cosmetic material as shown in FIG. 4. Accordingly, after the cosmetic material impregnated in the impregnation member 50 has been discharged, the cosmetic material stored in the cosmetic material storage grooves 51 is absorbed into the impregnation member 50 so that a user may not refill the cosmetic material frequently to feel convenient.

As the cosmetic material storage grooves 51 are not formed through the impregnation member 50, the cosmetic material stored in the cosmetic material storage grooves 51 may be prevented from being simultaneously excessively discharged when the discharge plate 60 is pressed. If the cosmetic material storage grooves 51 are formed through the impregnation member 50, the cosmetic material in the cosmetic material storage grooves 51 are simultaneously discharged when the discharge plate 60 is pressed, so that the cosmetic material is spouted from the discharge holes 62 and thus wasted thereby making surroundings in a mess.

In addition, an elastic member 55 is further provided between a lower portion of the receiving container bonding part 41 of the impregnation member receiving container 40 and the bottom surface 11 of the container body 10. The elastic member 55 helps the impregnation member receiving container 40 to return to the original state after the impregnation member receiving container 40 has been distorted.

The discharge plate 60 is bonded to the upper end of the impregnation member receiving container 40, formed at an edge thereof with a discharge plate bonding part 61 and formed therein with the discharge holes 62.

The cosmetic material is discharged from the discharge hole 62, and used using a puff P as shown in FIG. 6.

The receiving container bonding part 41 formed at an upper edge of the impregnation member receiving container 40 is mutually bonded to the discharge plate bonding part 61 formed at a lower edge of the discharge plate 60 to form a bonding part 70.

The bonding part 70 is formed through thermal bonding, ultrasonic bonding, or high frequency bonding schemes to prevent the cosmetic material from leaked.

The bonding part 70 is formed under a horizontal extension member 81 of the fixing member 80 coupled to the upper end of the container body 10.

The fixing member 80 includes the horizontal extension member 81 extending inward and a downward extension member 82 extending downward from the horizontal extension member 81.

The horizontal extension member 81 is rested on an upper end of the inner wall 12 of the container body 10 in contact with the bonding part 70 to prevent the integrated container 30 from being separated upward.

The downward extension member 82 is formed in an inner circumferential surface thereof with the coupling groove 821, and the coupling groove 821 is engaged with the coupling protrusion 121 formed on the outer circumferential surface of the inner wall 12 of the container body 10, thereby preventing the fixing member 80 from being separated from the container body 10.

Hereinafter, the assembling method and the use state of the cosmetic container having the cosmetic material storage groove formed in the impregnation member according to the embodiment of the present invention.

In order to assemble the cosmetic container having the cosmetic material storage groove formed in the impregnation member according to the present invention, the container cover 20 is coupled to the container body 10.

Thereafter, the elastic member 55 is mounted in the container body 10, and the integrated container 30 is fitted into the elastic member 55. The integrated container 30 includes the impregnation member receiving container 40 formed of a flexible material, the impregnation member 50 received in the impregnation member receiving container 40 and impregnated with the cosmetic material, and the discharge plate 60 bonded to an upper end of the impregnation member receiving container 40 and formed therein the discharge hole 62.

In this case, the impregnation member 50 is formed in the lower end thereof with the cosmetic material storage grooves 51 to store a larger number of cosmetic materials.

Thereafter, the receiving container bonding part 41 formed in the impregnation member receiving container 40 is bonded to the discharge plate bonding part 61 formed in the discharge plate 60 through a thermal bonding, ultrasonic bonding, or high frequency bonding scheme to form the bonding part 70, thereby preventing the cosmetic material from leaked.

Thereafter, the fixing member 80 is coupled to an upper end of the container body 10 to prevent the integrated container 30 from deviating from the container body 10.

In order to use the cosmetic container having the cosmetic material storage groove formed in the impregnation member assembled in the above manner, after opening the container cover 20, the discharge plate 60 is pressed as shown in FIG. 6.

If the discharge plate 60 is pressed, the elastic member 55 is compressed while the impregnation member receiving container 40 formed of the flexible material is distorted to press the impregnation member 50 provided in the impregnation member receiving container 40.

In this case, the cosmetic material impregnated in the impregnation member 50 is discharged through the discharge hole 62 in the discharge plate 60 so that a user may make up by applying the discharged cosmetic material to the puff P.

Thereafter, as shown in FIG. 7, if the pressing of the discharge plate 60 is released, the impregnation member receiving container 40 returns to the original state thereof by the elastic member 55, the impregnation member receiving container 40 formed of the flexible material, and the impregnation member 50 having elastic force.

Even if the cosmetic material impregnated in the impregnation member 50 as describe above is used up, since the cosmetic material is additionally stored in the cosmetic material storage grooves 51 formed in the impregnation member 50, the cosmetic material may be filled in the impregnation member 50 for a long time. Accordingly, the user may not frequently refill the cosmetic material and may conveniently use the cosmetic material.

As described above, although a cosmetic container having a cosmetic material storage groove formed in an impregnation member according to the present invention has been described for the illustrative purpose, the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERALS

10: Container body
11: Bottom surface
12: Inner wall
121: Coupling protrusion
13: Outer wall
14: Hinge bracket
20: Container cover
21: Hinge block
22: Hinge pin
30: Integrated container
40: Impregnation member receiving container
41: Receiving container bonding part
50: Impregnation member
51: Cosmetic material storage groove
55: Elastic member
60: Discharge plate
61: Discharge plate bonding part
62: Discharge port
70: Bonding part
80: Fixing member
81: Horizontal extension member
82: Downward extension member
821: Coupling groove

The invention claimed is:

1. A cosmetic container comprising:

a container body (10);

a container cover (20) coupled to one side of the container body (10); and an integrated container (30) provided integrally in the container body (10), wherein the integrated container (30) comprises:

an impregnation member receiving container (40) constructed from a flexible material wherein the impregnation member receiving container (40) is received in the container body (10);

an impregnation member (50) that is a single layer and is received in the impregnation member receiving container (40) and is impregnated with a cosmetic material; and a discharge plate (60) bonded to an upper end of the impregnation member receiving container (40) wherein the discharge plate (60) includes at least one discharge hole (62), wherein the single layer impregnation member (50) includes an cosmetic material storage groove (51)

formed therein such that the cosmetic material is also stored within the cosmetic material storage groove (51), wherein the cosmetic material storage groove (51) is formed with a predetermined depth from a bottom surface of the impregnation member (50) such that the cosmetic material storage groove (51) does not pass through the impregnation member (50), wherein a receiving container bonding part (41) is formed on an edge of the impregnation member receiving container (40), a discharge plate bonding part (61) is formed on an edge of the discharge plate (60), and the receiving container bonding part (41) is mutually bonded to the discharge plate bonding part (61) to form a bonding part (70) such that the integrated container (30) is assembled as one part, wherein when the discharge plate (60) is pressed, the impregnation member receiving container (40) is distorted and presses the impregnation member (50) provided in the impregnation member receiving container (40) such that the cosmetic material impregnated in the impregnation member (50) is discharged through the discharge hole (62).

2. The cosmetic container of claim 1, further comprising a fixing member (80) additionally coupled to an upper portion of the container body (10) to fix the integrated container (30) such that the integrated container (30) is prevented from deviating from the container body (10).

3. The cosmetic container of claim 1, further comprising an elastic member (55) additionally coupled to an outer side portion of the integrated container (30) to increase elasticity of the integrated container (30).

4. The cosmetic container of claim 1, wherein the bonding part (70) is formed through a thermal bonding scheme, an ultrasonic bonding scheme, or a high frequency bonding scheme.

* * * * *